US008375692B2

(12) United States Patent
Rebouillat et al.

(10) Patent No.: US 8,375,692 B2
(45) Date of Patent: Feb. 19, 2013

(54) COMPOSITE CORD HAVING A METAL CORE AND METHOD OF MAKING

(75) Inventors: Serge Rebouillat, Echenevex (FR); Olivier Rozant, Cernex (FR); Frederic Fleury, Geneva (CH)

(73) Assignee: E I du Pont de Nemours and Company, Wilmington, DE (US)

( * ) Notice: Subject to any disclaimer, the term of this patent is extended or adjusted under 35 U.S.C. 154(b) by 20 days.

(21) Appl. No.: 13/181,604

(22) Filed: Jul. 13, 2011

(65) Prior Publication Data

US 2012/0174556 A1 Jul. 12, 2012

Related U.S. Application Data

(60) Provisional application No. 61/364,939, filed on Jul. 16, 2010.

(51) Int. Cl.
*D02G 3/48* (2006.01)

(52) U.S. Cl. ..... 57/210; 57/231

(58) Field of Classification Search ..... 57/210, 57/231; 152/451, 527, 556, 557
See application file for complete search history.

(56) References Cited

U.S. PATENT DOCUMENTS

| | | | | |
|---|---|---|---|---|
| 3,063,966 | A | 11/1962 | DuPont | |
| 3,767,756 | A | 10/1973 | Blades | |
| 3,869,429 | A | 3/1975 | Blades | |
| 3,869,430 | A | 3/1975 | Blades | |
| 4,176,705 | A | 12/1979 | Russell et al. | |
| 4,384,449 | A * | 5/1983 | Byrnes et al. | 57/210 |
| 4,807,680 | A | 2/1989 | Weidenhaupt et al. | |
| 4,878,343 | A | 11/1989 | Weidenhaupt et al. | |
| 5,551,498 | A | 9/1996 | Komatsuki | |
| 6,334,293 | B1 * | 1/2002 | Poethke et al. | 57/210 |
| 6,534,175 | B1 * | 3/2003 | Zhu et al. | 428/365 |
| 6,658,836 | B2 * | 12/2003 | Nguyen et al. | 57/218 |
| 6,755,226 | B2 * | 6/2004 | Miyazaki et al. | 152/451 |
| 2009/0159171 | A1 | 6/2009 | Volpi | |
| 2010/0200142 | A1 * | 8/2010 | Wakahara et al. | 152/539 |
| 2012/0180926 | A1 * | 7/2012 | Rebouillat et al. | 152/527 |

FOREIGN PATENT DOCUMENTS

| | | |
|---|---|---|
| EP | 1036235 | 5/2003 |

* cited by examiner

*Primary Examiner* — Shaun R Hurley

(57) ABSTRACT

A composite hybrid cord comprising a core comprising of a first bundle of metal filaments and a plurality of cabled strands helically wound around the core, each cabled strand comprising of a plurality of synthetic filaments having a filament tenacity of from 10 to 40 grams per decitex helically wound around a center second bundle of metal filaments. The ratio of the largest cross sectional dimension of the first bundle of metal filaments to the largest cross sectional dimension of the second bundle of metal filaments is from 1.5:1 to 20:1. The synthetic filaments of the cabled strands have an elongation at break that is no more than 25 percent different from the elongation at break of the metal filaments of the first and second bundles.

14 Claims, 1 Drawing Sheet

COMPOSITE CORD HAVING A METAL CORE AND METHOD OF MAKING

BACKGROUND OF THE INVENTION

1. Field of the Invention

The present invention relates to the field of cords useful for the reinforcement of support structures in elastomeric and rubber articles.

2. Description of the Related Art

Combinations of aramid fibers and metal strands have been disclosed in several publications, including U.S. Pat. Nos. 5,551,498; 4,176,705; 4,807,680; 4,878,343 and United States Patent Application Publication 2009/0159171. Continued improvements in areas such as the adhesion of cords to rubber, strength retention and durability, of cords and lighter weight support structures comprising cords are highly desirable. This invention addresses these objectives.

BRIEF SUMMARY OF THE INVENTION

In one embodiment, this invention relates to a composite hybrid cord, and a support structure and a tire comprising the cord, the composite cord comprising a core of metal filaments and cabled strands of synthetic filaments helically wound around the core, wherein the synthetic filaments have a filament tenacity of from 10 to 40 grams per decitex (9 to 36 grams per denier).

In another embodiment, this invention relates to a composite hybrid cord, and a support structure and a tire comprising the cord, the composite hybrid cord comprising a core comprising a first bundle of metal filaments and a plurality of cabled strands helically wound around the core, each cabled strand comprising a plurality of synthetic filaments helically wound around a center second bundle of metal filaments and wherein the synthetic filaments have a filament tenacity of from 10 to 40 grams per decitex; and wherein the ratio of the largest cross sectional dimension of the first bundle of metal filaments to the largest cross sectional dimension of the second bundle of metal filaments is from 1.5:1 to 20:1. The synthetic filaments of the cabled strands have an elongation at break that is no more than 25 percent different from the elongation at break of the metallic filaments of the first and second bundles.

This invention also relates to a method of forming a composite cord, comprising the steps of:

a) forming or providing a first bundle of metal filaments;

b) forming or providing a second bundle of metal filaments; wherein the ratio of the largest cross sectional dimension of the first bundle of metal filaments to the largest cross sectional dimension of the second bundle of metal filaments is in the range of from 1.5:1 to 20:1;

c) helically winding a plurality of synthetic strands around the second bundle of metal filaments to form a cabled strand having a center of metal filaments wherein the synthetic filaments of the cabled strands have an elongation at break that is no more than 25 percent different from the elongation at break of the metallic filaments of the first and second bundles, and d) helically winding a plurality of the cabled strands around the first bundle of metal filaments to form a composite hybrid core having a core of metal filaments.

DETAILED DESCRIPTION OF THE INVENTION

Composite Hybrid Cord

This invention relates to a composite hybrid cord. By "hybrid" it is meant the cord contains at least two different strength materials. By "composite" it is meant the cord contains cabled strands wrapped or wound around a core. As used herein a "strand" is either a single continuous synthetic filament; or multiple continuous synthetic filaments that are twisted, intermingled, roved or assembled together to form a cable that can be handled and wound similarly to a single continuous metal filament or wire. A "cabled strand" as used herein represents a plurality of synthetic strands wound around a center bundle of metallic filaments. By "bundle of filaments" is meant an assembly of filaments, generally in the form of one filament or a combination of two or more filaments.

"Filament" as used herein means a relatively flexible, macroscopically homogeneous body having a high ratio of length to width across its cross-sectional area perpendicular to its length. The filament cross section can be any shape, but in preferred embodiments is round or essentially round.

The cross sections of the synthetic and metallic filaments may be the same or different. The synthetic fiber may contain filaments having different cross sections. Wire having different cross sections may also be used. The cross sectional shape can be changed during processing depending on the processing conditions before, during, or after the manufacturing of the filament, the yarn, the strand, the cord or the article. Tensioning, flattening, molding or passing through a calibrated die are among the means available to tailor the cross-sectional shape. Herein, the term "fiber", with respect to synthetic material, is used interchangeably with the term "filament". The term "wire", with respect to metal, may also be used interchangeably with the term "filament".

The synthetic filaments and wire may be continuous, semi-continuous or discontinuous. Suitable, examples include, but are not limited to staple filament or wire, stretch-broken filament or wire, wire or filament made of any form based on short fibers.

Figure 1:
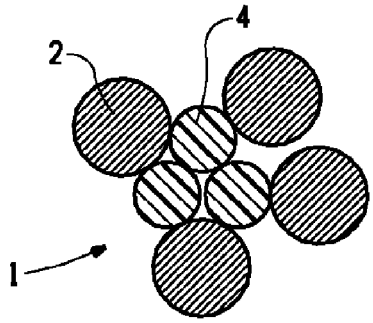
FIG. 1 is an illustration of one embodiment of a composite hybrid cord.

As shown by cross section in FIG. 1, the composite hybrid cord 1 comprises a core of three (3) metal filaments 4 and four (4) cabled strands 2 of synthetic filaments helically wound around the core.

Figure 2:
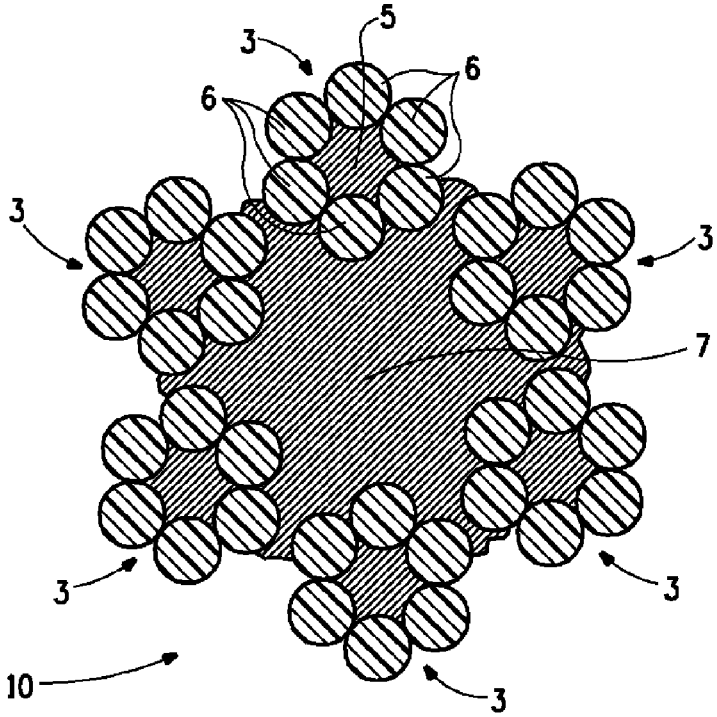
FIG. 2 is an illustration of another embodiment of a composite hybrid cord.

As shown by a cross section in FIG. 2, the composite hybrid cord 10 comprises a core of a first bundle of metal filaments 7 and a plurality of cabled strands 3 helically wound around the core, each cabled strand comprising of a plurality of synthetic strands 6 helically wound around a center second bundle of metal filaments 5. In an alternative embodiment, metal filaments 5 may be replaced with synthetic strands that are different either in composition or physical properties from synthetic strands 6. In such an embodiment, the cabled strand comprises a plurality of first synthetic strands helically wound around a center bundle of second synthetic strands.

Metal Filaments

The core of the composite hybrid cord consists of a first bundle of metal filaments. The metal filaments used can consist of a continuous single wire or it may consist of multiple continuous wires twisted, intermingled, roved or assembled together. The metal filaments may also be formed from staple and/or stretch-broken wires. The wires can be linear, non linear, zig-zag or in the form of two-dimensional or three-dimensional structures. The wires can have any suitable cross-sectional shape such as elliptical, round or star shaped. In some embodiments, channels or groves are formed into the wire using a die. Such grooves are formed along the length of the wire and may be in the form of straight lines or cut helically around the wire. The grooves facilitate the flow of rubber or cord treating agent around the wire and aid adhesion between the rubber and the wire. In some embodiments the metal wire is steel. In one embodiment, the elongation at break of the metal wire is no greater than 25% different from the elongation at break of the synthetic fiber in the cable strands. In another embodiment, the difference is no greater than 15% and in yet another embodiment the difference is no greater than 10%. Ideally, the elongations at break of the synthetic filaments and metallic filaments are the same. Typical values for elongation at break of the steel wire are in the range of from 2.3 to 5.7%. In some embodiments, the elongation at break of the steel wire is from 2.4 to 4.8%. A composite hybrid cord structure in which the elongations at break of the components of the cord are the same or within twenty five percent of each other optimizes the mechanical efficiency of the cord under conditions of use.

A process as described in European Patent (EP) 1036235 B1 is one way of producing metallic wire having a predetermined elongation at break. Crimped wires of this type are available from N. V. Bekaert S. A., Zwevegem, Belgium ("herein Bekaert") under the tradename High Impact Steel.

The wires are typically provided with a coating conferring affinity for rubber. Preferred coatings are copper, zinc and alloys of such metals, for example brass.

The individual metal wires used as filaments in the strands can have a diameter of about 0.025 mm to 5 mm. In some embodiments, wires having a diameter of 0.10 mm to 0.25 mm are preferred. In some embodiments, so-called "fine steel", which has a diameter of about 0.04 mm to 0.125 mm are preferred. Filaments based on carbon, glass or ceramic may also be present in the first and/or second bundles.

Figure 3A:
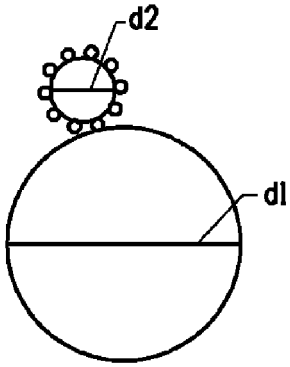
FIGS. 3A and 3B are further cross-sections of exemplary composite hybrid cords of FIG. 2.
Figure 3B:
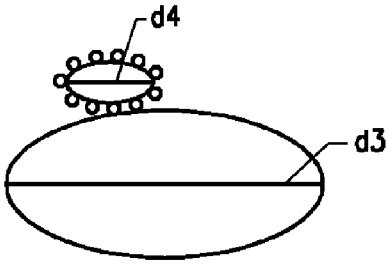

The first and second bundles may be of any suitable cross sectional shape. In some embodiments, the cross section is round, oval or bean shaped. The largest cross sectional dimension of the bundle is a convenient dimension for showing the dimensional relationship between the first and second bundles. The ratio of the largest cross sectional dimension of the first bundle of metallic filaments to the largest cross sectional dimension of the second bundle of metallic filaments is in the range of 1.5:1 to 20:1 or even from 3:1 to 10:1. FIG. 3A shows a substantially circular shaped first bundle of synthetic filaments having a largest cross sectional dimension d1 and one cabled strand on the perimeter of the first bundle. The cabled strand comprises a substantially circular shaped second bundle of metal filaments having a largest cross sectional dimension d2 surrounded by a plurality of synthetic filament strands. FIG. 3B shows a substantially oval shaped first bundle of metal filaments having a largest cross sectional dimension d3 and one cabled strand on the perimeter of the first bundle. The cabled strand comprises a substantially oval-shaped second bundle of metal filaments having a largest cross sectional dimension d4 surrounded by a plurality of synthetic strands. Accordingly, the ratio of d1:d2 and d3:d4 is in the range of 1.5:1 to 20:1.

Cabled Strands

A plurality of cabled strands is helically wound around the first bundle of metal filaments that form the core of the composite hybrid cord. In addition, each cabled strand consists of a plurality of synthetic strands that are helically wound around a center bundle of metal filaments that is the second bundle of synthetic filaments as described previously. In one embodiment, the plurality of synthetic strands forms an effective complete cover of the center second bundle of metal filaments. This is believed to help the adhesion of the composite hybrid cord to the elastomer that is being reinforced by mitigating any effects or lessening the need for any special treatments to facilitate the adhesion between the synthetic filaments and the elastomer. In other embodiments, the number of synthetic strands wound around the second bundle of filaments is selected so as to cover at least 30 percent of the second bundle of filaments. In another embodiment, the synthetic strands cover at least 75 percent or even 95 percent of the second bundle of filaments. Coverage greater than 95% of the second bundle of metal filaments is considered to be an effective complete covering. The number of synthetic strands that forms the plurality needed to form an effective complete cover of the center second bundle of filaments is dependent on many factors, including the desired cord design, the cross-sectional dimensions of the synthetic strands and the cross-sectional dimensions of the center bundle of metal filaments. In some embodiments from two to ten synthetic strands form a cabled strand. In some embodiments, the number of cabled strands wound around the core is four or more. In some embodiments, the number of cabled strands wound around the core can be as high as twenty.

In another embodiment, the number of cabled strands wound around the core first bundle of filaments is selected such that the cabled strands cover at least 30 percent of the core bundle of filaments. In another embodiment, the cabled strands cover at least 75 percent or even 95 percent of the core first bundle of filaments. Coverage greater than 95% of the first bundle of metal filaments is considered to be an effective complete covering. It is believed this allows any resins or coatings used in the manufacture of reinforced rubber goods to fully penetrate between the cabled strands, all the way to the core of the cord, while still providing good rubber to metal adhesion. In yet another embodiment, the cabled strands cover the entire core bundle of filaments.

The preferred coverage of cabled strands over the first bundle largely depends on the chemical, morphological and the surface characteristics of the filament, yarn and strand. Similarly, the degree of coverage of cabled strands over the first bundle can be selected to tailor the level of interactions between the hybrid cord elements and the surrounding environment. The surrounding environment includes materials such as rubber, elastomer, thermoset polymers, thermoplastic polymers or combinations thereof. For example, in one embodiment, the polymeric filament may exhibit better adhesion to the rubber when compared to the adhesion of wire to rubber. In some embodiments, the cabled strands are helically wound around the core at a helical angle of from 0 to 45 degrees or from 5 to 30 degrees or even from 18 to 25 degrees in order to promote good matching of elongation at break between the core and the cabled strands. In some embodiments, the cabled strands are helically wound at a helical angle of from 10 to 20 degrees. The helical angle is the angle formed by the path of a cabled strand in relation to the major axis of the core. The expression helix angle is used equivalently with helical angle. The selection of the helical angle is dependent on the elongation properties of the selected materials. For example, if the selected materials have low elongation properties, then too high a helical angle can cause severe damage in use. Likewise, in some embodiments, the synthetic strands can be helically wound around the center second bundle of metal filaments at a helical angle suitable to provide similar elongations at break between the synthetic filaments and the metal filaments in the first and second bundles. Suitable helical angles are from 0 to 45 degrees or from 5 to 30 degrees or even from 8 to 25 degrees. In another embodiment, the helical angle is from 10 to 20 degrees.

Synthetic Filaments

The synthetic cable strands include filaments having a filament tenacity of from 10 to 40 grams per decitex. In some other embodiments the filament tenacity is from 10 to 30 grams per decitex (9 to 27 grams per denier). In yet another embodiment, the filament tenacity of synthetic filaments is from 10 to 27 grams per decitex (9 to 24 grams per denier).

By synthetic filaments it is meant the filaments are made from synthetic polymers, that is, polymers that have been synthesized from various chemical monomers or are otherwise man-made polymers. In some embodiments, the synthetic filaments are aramid fibers. A preferred aramid fiber is para-aramid. By para-aramid fibers is meant fibers made from para-aramid polymers; poly (p-phenylene terephthalamide) (PPD-T) is the preferred para-aramid polymer. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid.

Another suitable fiber is one based on aromatic copolyamide prepared by reaction of terephthaloyl chloride (TPA) with a 50/50 mole ratio of p-phenylene diamine (PPD) and 3,4'-diaminodiphenyl ether (DPE). Yet another suitable fiber is that formed by polycondensation reaction of two diamines, p-phenylene diamine and 5-amino-2-(p-aminophenyl) benzimidazole with terephthalic acid or anhydrides or acid chloride derivatives of these monomers.

Additives can be used with the para-aramid in the fibers and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. Fillers and/or functional additives made of mineral, organic or metallic matter can be incorporated into the polymer as long as they do not adversely affect the performance of the filaments or yarn bundles. Such additives may be micron size or nano size materials. Continuous para-aramid fibers, that is, fibers of extreme length are generally spun by extrusion of a solution of the p-aramid through a capillary into a coagulating bath. In the case of poly(p-phenylene terephthalamide), the solvent for the solution is generally concentrated sulfuric acid, the extrusion is generally through an air gap into a cold, aqueous, coagulating bath. Such processes are generally disclosed in U.S. Pat. Nos. 3,063,966; 3,767,756; 3,869,429, & 3,869,430. Para-aramid filaments and fibers are available commercially as Kevlar® fibers, which are available from E.I. du Pont de Nemours & Co., Wilmington Del. ("herein DuPont") and Twaron® fibers, which are available from Teijin Aramid BV, Arnhem, Netherlands. In addition to continuous filaments, the fiber may also be made from staple fiber. Staple fiber is fiber having a short length for example from about 20 mm to about 200 mm. Spinning of staple fiber is a well known process in the textile art. Stretch-broken fiber may also be used. Blends of continuous filaments, staple or stretch-broken fiber may also be utilized. In one embodiment, the synthetic filaments comprise continuous para-aramid filaments having a modulus of from 5 to 15 N/decitex. In some other embodiments, fibers having a higher modulus, such as from 2 to 600 GPa may be used.

One or more filament yarns may be used to make up the synthetic filaments used for the cabled strands. The core may have any suitable cross sectional shape before being wound with the cabled strands; however, once the core is wound with the cabled strands, it can take on a more complex cross-sectional shape, such as the multi-pointed star shape shown in FIG. 2. In one embodiment the core has an essentially round cross-section. In another embodiment the core has an essentially elliptical cross-section.

An example of a yarn that can be used as a cable strand is a poly (paraphenylene terephthalamide) continuous multifilament yarn having a linear density of about 30-30000 decitex or about 1000-10000 decitex, or even about 1500-4000 decitex. In some embodiments, the cable strand is comprised of one or more continuous multifilament yarns each having linear densities of about 1600-3200 decitex.

The synthetic filaments of the cabled strands may be chemically treated to provide additional functionality to the cord. Depending on the use and the environment, suitable treatments include, but are not limited to, lubricants, water barrier coatings, adhesion promoters, conductive materials and anti-corrosion agents and chemical resistance enhancers. In some embodiments, a resorcinol formaldehyde latex (RFL) coating is used as an adhesion promoter and/or a stress buffering gradient that is well suited for rubber-to-fabric textile bonding. In other embodiments, thermoplastic polyester elastomer or fluoropolymer treatments are used. A suitable polyester elastomer is HYTREL®. A suitable fluoropolymer is TEFZEL®. The materials may also include micron scale as well as nano scale formulated organic or mineral ingredients. Such materials may also be sacrificial in nature that is, they are consumed or removed or modified during or after processing. Methods for applying such treatments are well known in the art and include extrusion, pultrusion, solution coating, melt or powder coating or pretreatment with etching, plasma, corona and other electrostatic discharges. For example chemical acid treatment of the aramid components can enhance adhesion without significant loss of strength.

This invention also relates to a method of forming a composite hybrid cord, comprising the steps of:

a) forming or providing a first bundle of metal filaments b) forming or providing a second bundle of metal filaments wherein the ratio of the largest cross sectional dimension of the first bundle of metal filaments to the largest cross sectional dimension of the second bundle of metal filaments is from 1.5:1 to 20:1;

c) helically winding a plurality of synthetic strands having a filament tenacity of from 10 to 40 grams per decitex; around the second bundle of metal filaments to form a cabled strand having a center of metal filaments wherein the synthetic filaments of the cabled strands have an elongation at break that is no more than 25 percent different from the elongation at break of the metal filaments of the first and second bundles, and d) helically winding a plurality of the cabled strands having a filament tenacity of from 10 to 40 grams per decitex; around the first bundle of metal filaments to form a composite hybrid core having a core of metal filaments.

The first bundle of metal filaments can be formed by combining a plurality of metallic filaments to form the desired core. Separately or concurrently, a plurality of cabled strands can be formed by combining the desired number of synthetic strands and the second bundle of metal filaments and helically winding the synthetic strands around the second bundle of metal filaments such that the second bundle of metal filaments are positioned in the center of the cabled strand. Preferably, the number and size of synthetic strands and the cross-sectional dimension of the second bundle of metal filaments are selected such that the synthetic strands form an effective complete covering of the center second bundle of metal filaments.

A plurality of these synthetic cabled strands is then helically wound around the core of first bundle of metal filaments to form the composite hybrid cord. In one embodiment, the number and size of cabled strands and the largest dimension of the first bundle of filaments is selected such that the cabled strands do not completely cover the core first bundle of filaments. In other instances the amount of coverage will be selected depending the desired cord performance and on the level of interactions needed between the metal filaments, the synthetic strand and the rubber or elastomeric environment. Such performance characteristics include fatigue and stress buffering.

Conventional cabling machines can be used to produce the cabled strands and the composite hybrid cords.

The composite hybrid cord is useful for reinforcing an elastomeric, thermoset, thermoplastic or rubber composition including combinations thereof. Such compositions find use in tires, belts, hoses, reinforced thermoplastic pipes, ropes, cables, tubes, multi-layer or flat structures and other reinforced articles. The compositions may be partially or totally reticulated depending on the desired hardness and/or stress buffering of the rubber. Tires containing composite hybrid cords may be used in automobiles, trucks, vehicles for the construction and mining industries, motorcycles and sport and recreational vehicles. In comparison to pure steel reinforcement cord, the composite hybrid cord can contribute to a reduction in weight of the tire and can help improve the overall efficiency and durability of the tire.

To incorporate the composite hybrid cord into a tire, one or more cords are incorporated into an elastomeric or rubber matrix to form a support structure. Exemplary support structures include, but are not limited to, a carcass, a cap-ply, a bead reinforcement chafer (a composite strip for low sidewall reinforcement) and a belt strip. The matrix can be any elastomeric, thermoset, thermoplastic or rubber material and combinations thereof that can keep multiple cords in a fixed orientation and placement with respect to each other. Suitable matrix materials include both natural rubber, synthetic natural rubber and synthetic rubber. Synthetic rubber compounds can be any which are capable of dispersion, for example in latex, or dissolvable by common organic solvents. Rubber compounds can include, among many others, polychloroprene and sulfur-modified chloroprene, hydrocarbon rubbers, butadiene-acrylonitrile copolymers, styrene butadiene rubbers, chlorosulfonated polyethylene, fluoroelastomers, polybutadiene rubbers, polyisoprene rubbers, butyl and halobutyl rubbers and the like. Natural rubber, styrene butadiene rubber, polyisoprene rubber and polybutadiene rubber are preferred. Mixtures of rubbers may also be utilized. The support structure is then fitted into the structure of the tire, for example under the tread.

EXAMPLES

In the following Examples, the p-aramid fiber used was from DuPont under the tradename KEVLAR®. Steel wire was obtained from Bekaert.

The following examples are given to illustrate the invention and should not be interpreted as limiting it in any way. Examples prepared according to the process or processes of the current invention are indicated by numerical values. Control or Comparative Examples are indicated by letters.

Example 1

A core was made of three HI grade steel wires from Bekaert having a diameter of 0.20 mm and an elongation at break of 3.8%. A cabled strand was made of seven Kevlar® 29 yarns having a linear density of 800 decitex, a tenacity of 26.7 grams per decitex, a modulus of 692 grams per decitex and an elongation at break of 3.3% helically wrapped around a core yarn of Kevlar® 29 filaments at a helical angle of 12 degrees. The Kevlar® 29 yarn of the core had a linear density of 1667 decitex, a tenacity of 26 grams per decitex, a modulus of 644 grams per decitex and an elongation at break of 3.5%. Prior to forming the composite cord, the cabled strands were dipped in a resorcinol-formaldehyde-latex (RFL) resin bath to impregnate the yarns with 10 weight percent of the RFL coating relative to the total weight of the coated yarn in the cabled strand. Four cabled strands were wrapped around the core at an angle of 18.7 degrees to form a composite hybrid cord. The ratio of the largest cross sectional dimension of the metal core to the largest cross sectional dimension of the Kevlar® 29 yarn forming the core of the cabled strand was 3.44:1. When the cord is subjected to a break test, the steel core filaments and the Kevlar® filaments of the cabled strand are predicted to all break at the same elongation of 3.8% corresponding to a maximum breaking force of 1559 N.

The invention claimed is:

1. A composite hybrid cord comprising:

i) a core comprising a first bundle of metal filaments and ii) a plurality of cabled strands helically wound around the core, each cabled strand comprising of a plurality of synthetic strands having a filament tenacity of from 10 to 40 grams per decitex helically wound around a center second bundle of metal filaments, wherein (a) the ratio of the largest cross sectional dimension of the first bundle of metal filaments to the largest cross sectional dimension of the second bundle of metal filaments is in the range of 1.5:1 to 20:1, and (b) the synthetic filaments of the cabled strands have an elongation at break that is no more than 25 percent different from the elongation at break of the metal filaments of the first and second bundles.

2. The cord of claim 1, wherein the cabled strands cover from 30 to 95 percent of the first bundle of metal filaments.

3. The cord of claim 1, wherein the cabled strands form an effective complete cover of the first bundle of metal filaments.

4. The cord of claim 1, wherein the plurality of synthetic strands cover from 30 to 95 percent of the center second bundle of metal filaments.

5. The cord of claim 1, wherein the plurality of synthetic strands forms an effective complete cover of the center second bundle of metal filaments.

6. The cord of 1, wherein the first and second bundle of metal filaments comprise steel wire having a diameter of from 0.04 mm to 5 mm.

7. A composite hybrid cord comprising:

i) a core comprising a bundle of metal filaments, and ii) a plurality of cabled strands helically wound around the core, each cabled strand comprising of a plurality of first synthetic strands having a filament tenacity of from 10 to 40 grams per decitex helically wound around a center bundle of second synthetic strands having a filament tenacity of from 10 to 40 grams per decitex, wherein (a) the ratio of the largest cross sectional dimension of the core to the largest cross sectional dimension of the center bundle of second synthetic strands is in the range of 1.5:1 to 20:1, (b) the first synthetic strands are different from the second synthetic strands, and (c) the synthetic strands of the cabled strands have an elongation at break that is no more than 25 percent different from the elongation at break of the metal filaments of the core.

8. The cord of claim 1 or 7, wherein the synthetic filaments are poly (paraphenylene terephthalamide) filaments.

9. The cord of claim 1 or 7, wherein the synthetic filaments have a tensile modulus of from 5 to 15 N/decitex.

10. The cord of claim 1, wherein the ratio of the largest cross sectional dimension of the first bundle of metal filaments to the largest cross sectional dimension of the second bundle of metal filaments is in the range of 3:1 to 10:1.

11. The cord of claim 1 or 7, wherein the metal filaments comprise grooves.

12. The cord of claim 1 or 7, wherein the synthetic and metal filaments have a structure selected from the group consisting of continuous, staple or stretch broken.

13. A method of forming a composite hybrid cord, comprising the steps of:

a) forming or providing a first bundle of metal filaments b) forming or providing a second bundle of metal filaments; wherein the ratio of the largest cross sectional dimension of the first bundle of metal filaments to the largest cross sectional dimension of the second bundle of metal filaments is from 1.5:1 to 20:1;

c) helically winding a plurality of synthetic strands having a filament tenacity of from 10 to 40 grams per decitex around the second bundle of metal filaments to form a cabled strand having a center of metal filaments wherein the synthetic filaments of the cabled strands have an elongation at break that is no more than 25 percent different from the elongation at break of the metal filaments of the first and second bundles; and d) helically winding a plurality of the cabled strands around the first bundle of metal filaments to form a composite hybrid cord having a core of metal filaments.

14. The method of forming a cord of claim 13, wherein the synthetic filaments are aramid filaments.

* * * * *